US006414571B1

(12) United States Patent
Hunter et al.

(10) Patent No.: US 6,414,571 B1
(45) Date of Patent: Jul. 2, 2002

(54) DUAL TM MODE COMPOSITE RESONATOR

(75) Inventors: Ian Hunter; John David Rhodes, both of Shipley (GB)

(73) Assignee: Filtronic PLC (GB)

( * ) Notice: Subject to any disclaimer, the term of this patent is extended or adjusted under 35 U.S.C. 154(b) by 0 days.

(21) Appl. No.: 09/529,506

(22) PCT Filed: Oct. 14, 1998

(86) PCT No.: PCT/GB98/03072

§ 371 (c)(1),
(2), (4) Date: Aug. 22, 2000

(87) PCT Pub. No.: WO99/19933

PCT Pub. Date: Apr. 22, 1999

(30) Foreign Application Priority Data

Oct. 15, 1997 (GB) ..... 9721803

(51) Int. Cl.[7] ..... H01P 7/10; H01P 1/208
(52) U.S. Cl. ..... 333/219.1; 333/202
(58) Field of Search ..... 333/202, 219.1, 333/212, 227, 231, 235, 204, 99 S

(56) References Cited

U.S. PATENT DOCUMENTS 4,453,146 A * 6/1984 Fiedziuszko et al. ..... 333/212
5,172,084 A * 12/1992 Fiedziuszko et al. ..... 333/204

FOREIGN PATENT DOCUMENTS

WO WO-96/42118 * 12/1996

* cited by examiner

*Primary Examiner*—Robert Pascal
*Assistant Examiner*—Stephen E. Jones
(74) *Attorney, Agent, or Firm*—Fulwider Patton Lee & Utecht

(57) ABSTRACT

A microwave frequency composite resonator comprising a metal housing having an internal surface and defining a resonator cavity, a dielectric member having a top face and a bottom face and a conducting plate. The dielectric member is located within the resonator cavity and the bottom face of the dielectric member directly abuts the internal surface of the metal housing and the conducting plate directly abuts the top face of the dielectric member.

12 Claims, 7 Drawing Sheets

DUAL TM MODE COMPOSITE RESONATOR

BACKGROUND OF THE INVENTION

The present invention relates to a composite resonator and particularly, but not exclusively, to a composite resonator for use in devices operating at microwave frequencies in the field of cellular telecommunications.

Microwave resonators have a wide range of applications. In particular, in cellular telecommunications, microwave resonators are utilised in filters, multiplexers and power combining networks.

Filters are required with exacting specifications; e.g. narrow band pass filters with low pass band loss. For cellular base station applications combline filters are often used but have maximum resonator Q factors of a few thousand.

On the other hand dielectric resonators have Q values of up to 50000. However, they suffer from poor spurious response; i.e. the first spurious mode of the resonance is close in frequency to the fundamental mode. Consequently the low pass filtering required to clean up the stop band is very difficult to achieve. Further, conventional TE01Δ resonators are not suited to bandwidths above 5 MHz at 900 MHz because the field is mainly confined to the dielectric, consequently it is difficult to achieve strong input coupling.

The problem of spurious resonances may be addressed by using a low pass filter in conjunction with a band pass filter so that the low pass filter cuts off spurious resonance signals. However, such an approach requires a very sharp low pass filter characteristic as the separation in frequency between the desired resonance and spurious resonances is very small. This requires low pass filters which will transmit from DC to the highest frequency of the pass band, e.g. of order 1 GHz, but then cut off within approximately 100 MHz. The corner of the low pass filter must be sufficiently sharp that the low pass filter does not add to the loss in the pass band. A total loss of 1 dB at the central frequency of the pass band is typically required. Such requirements place severe demands on the design of the low pass filter if conventional dielectric resonators are to be employed.

Hence, there is a need for a resonator with a high Q, so that sufficiently sharp band pass characteristics can be achieved, and which does not have the associated problem of closely spaced spurious resonances which require the use of further filters with very severe filter characteristics in order to provide the desired overall filter response.

SUMMARY OF THE INVENTION

According to a first aspect of the invention there is provided a microwave frequency composite resonator comprising:

- a metal housing having an internal surface and defining a resonator cavity;
- a dielectric member; and
- a conducting plate, in which the dielectric member is located within the resonator cavity on the internal surface of the metal housing and the conducting plate is located on top of the dielectric member.

By providing a resonator having a dielectric member inside a resonator cavity and between a conducting plate and an internal surface of the metal housing forming the resonator cavity, the frequency response of the resonator provides a desired fundamental natural mode of the resonator having a resonant frequency which is well separated in frequency from the next natural mode of the resonator and the desired natural mode comprises a pair of orthogonal modes. The Q of the resonator at its resonant frequency is at least equal to that of a coaxial resonator in a similar physical volume.

Such a resonator has a resonant frequency which is well separated in frequency from the frequency of the next nearest natural mode. Hence a low pass filter with a less sharp response can be used in conjunction with a filter comprising resonators according to the current invention so as to provide a desired overall filter response.

The mode of resonance is a dual mode with a mode Q similar in value to that of a combline resonator of similar physical size. Consequently this provides for a 2:1 improvement in Q per unit volume. Thus a filter can be constructed with approximately half the physical size of a combline filter with the same electrical performance, or with similar size and much improved performance, i.e. lower loss.

The dielectric member may directly abut the internal surface of the housing. The conducting plate may directly abut a top surface of the dielectric member.

The dielectric member may be a substantially right angular cylinder. The conducting plate may be circular. Preferably, the values of the dielectric constant of the dielectric material is between 30 and 44, more preferably between 36 and 44.

The resonator may be configured such that at resonance the resonator sustains a dual TM mode resonance. The geometry of the resonator may be arranged such that at a desired resonant frequency of the resonator, the resonator sustains a dual TM mode standing wave microwave resonance at the desired resonant frequency.

The resonator may sustain a dual TM mode resonance in which the TM mode resonance comprises a pair of orthogonal modes. The geometry of the resonator may be arranged so that the TM resonance sustained has two modes which are sufficiently close in frequency that at the resonant frequency of the cavity both modes are excited. This provides an enhanced Q of the resonator, approximately double, compared to a similarly sized co-axial resonator which sustains a resonance having a single excitable mode.

The resonator may be configured such that a TE mode resonance of the resonator has a resonant frequency higher than the resonant frequency of the TM mode. By arranging the geometry of the resonator in a suitable way, the frequency separation of a TM mode of the resonator and a next nearest TE mode of the resonator may be inverted. In a freely suspended dielectric resonator, the TE mode is lower in frequency than the next nearest TM mode. However, the arrangement and geometry of the resonator may be suitably chosen, such that the TM mode becomes lower in frequency than the TE mode, i.e. the two modes cross over in frequency, and the separation in frequency of the TE mode and TM mode can be increased compared to the situation when the TE mode is lower in frequency than the TM mode.

The resonator may have an input coupling which couples input electrical signals to the conducting plate. This provides a means of coupling an electrical signal into the resonator and coupling electrical energy into the resonator so as to excite the resonator.

The input coupling and conducting plate may be arranged such that at resonance the radial component of the electric field of the resonant mode is directed diametrically across the conducting plate from the input coupling. Owing to the arrangement and geometry of the conducting plate, dielectric member and resonator cavity, the input coupling attached to the conducting plate establishes an electric field, the radial component of which extends diametrically across the conducting plate from the point where the input coupling attaches to the conducting plate.

There may be a notch in the circumference of the conducting plate. Providing a notch in the circumference of the conducting causes a second radial component of the electric field to be generated across the plate; i.e. a component of the second of the two orthogonal modes of the dual mode TM resonance. The angular position of the notch around the circumference determines the orientation of the second radial component of the electric field with respect to the first radial component of the electric field. Hence the single physical resonator can act as a pair of coupled resonators.

The notch may be located at an angle of 45° from the direction of the radial component of the electric field. Such an angular position of the notch generates a second radial component of the electric field in a direction orthogonal to the first radial component of the electric field; i.e. the second orthogonal component of the dual TM mode. The strength of the second transverse resonance is then maximised and approximately the same as that of the first resonance.

The resonator may have an output coupling which couples output electrical signals from the resonator. The output coupling outputs the electrical energy in the resonator as an electrical signal. The position of the output coupling is chosen so as to correspond to an appropriate radial component of the electric field across the conducting plate.

According to a second aspect of the invention there is provided a filter including a first microwave frequency resonator comprising:

- a metal housing having an internal surface and defining a resonator cavity;
- a dielectric member; and
- a conducting plate, in which the dielectric member is located within the resonator cavity on the internal surface of the metal housing and the conducting plate is located on top of the dielectric member.

The filter may have a second microwave frequency composite resonator. A number of resonators may be provided in a common housing so as to provide a filter having a desired filter characteristic.

The filter may have an input coupling which couples input electrical signals to the plate of the first resonator and an output coupling which couples output electrical signals from the conducting plate of the second resonator. The first and second resonators may be arranged such that there exists a coupling between the first physical resonator and the second physical resonator. An electrical signal can be input at the first resonator and then output form the second resonator having passed through the filter network formed by the resonators.

The filter may have a first notch in the circumference of the conducting plate of the first resonator and a second notch in the circumference of the conducting plate of the second resonator. By providing a notch in the conducting plate of a first resonator a second radial component of the electric field is generated in the first physical resonator. This electric field may then couple to the second resonator and induce a radial electric field in the conducting plate of the second resonator. The notch in the plate of the second physical resonator then causes a second radial electric field to be generated in the conducting plate. In this way the two physical resonators act as four coupled resonators.

The filter may have a first notch and a second notch which are angularly displaced such that a radial component of the electric field of a resonant mode in the first resonator couples only to a single radial component of the electric field of a resonant mode in the second resonator. In this way the physical resonators may act as a series of non-cross coupled resonators, in which the series of resonators is greater than the number of physical resonators.

The filter may have a first notch and a second notch which are angularly displaced such that a radial component of the electric field Of a resonant mode in the first resonator couples to both of a pair of radial components of the electric field of a resonant mode in the second resonator so as to cross couple the first and second resonators to provide poles in the filter response characteristic. In this way a series of resonators may be provided but having cross coupling between the resonators so as to allow poles to be provided in the filter response so that the filter characteristic can be modified. The strength of the cross coupling between resonators may be altered by altering the relative angle between the notches in the first and second plates.

The filter may have a tuning device. The relative position of the tuning device and a resonator may be altered so as to tune the resonant frequency of the resonator. The tuning device may comprise a conducting disc attached to an insulating member and the separation of the conducting disc and the conducting plate of a resonator may be altered. In this way the filter response may be corrected by providing a way of tuning the resonant frequency of the resonators in the filter.

The filter may be a band pass filter.

BRIEF DESCRIPTION OF THE DRAWINGS

The present invention will now be described, by way of example only, with reference to the accompanying drawings, in which.

DETAILED DESCRIPTION OF PREFERRED EMBODIMENTS

Figure 1A:
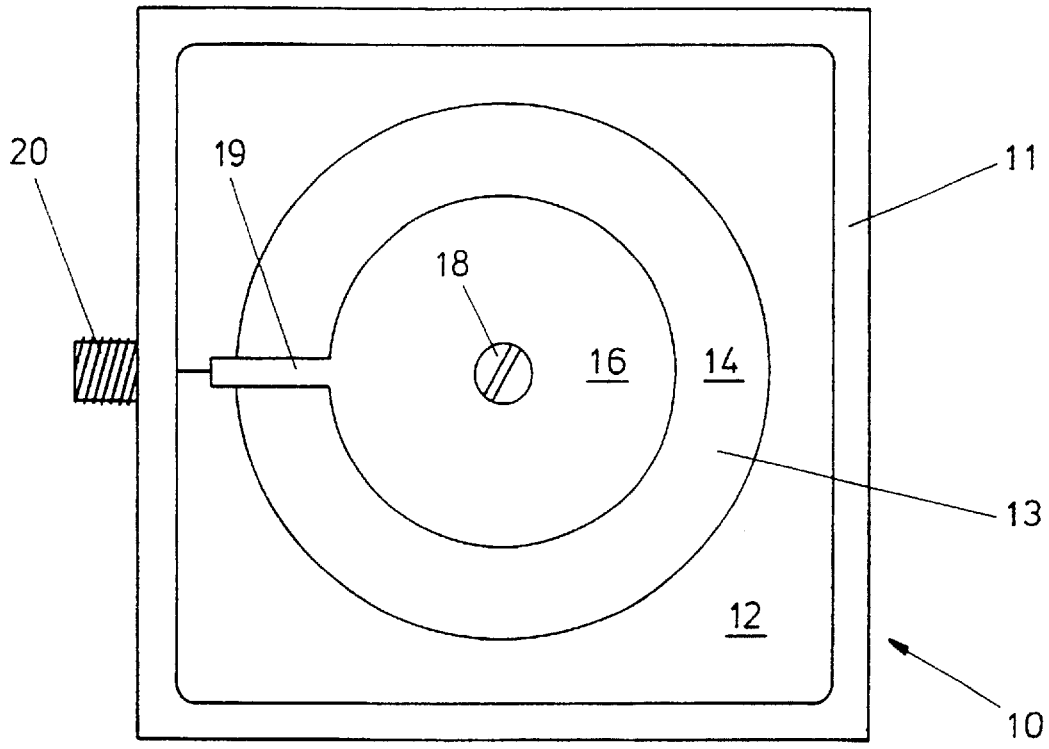
FIGS. 1*a* and 1*b* show schematic plan and cross sectional views of a resonator according to a first aspect of the invention.
Figure 1B:
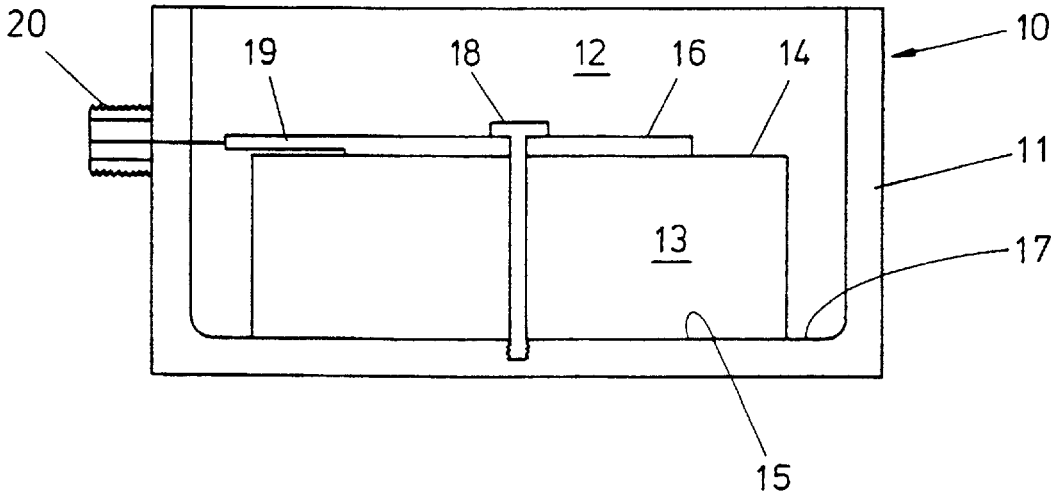

In the drawings, common items have the same reference numeral.

With reference to FIGS. 1*a* and b there is shown a plan and cross sectional view of a resonator according to the invention generally designated by reference numeral 10. The resonator has a square metal housing 11 which defines a resonator cavity 12. Preferably the housing is aluminium. A dielectric member 13 in the form of a right cylinder is located within the resonator cavity. The dielectric member has a top face 14 and a bottom face 15. The resonator also has a circular metal conducting plate 16. The circular metal conducting plate directly abuts the top face of the dielectric element and the bottom face of the dielectric element directly abuts an internal surface 17 of the metal housing. The plate, dielectric member and housing are retained by a screw 18 of insulating material. An input coupling 19 connects the metal plate to a co-axial connector 20 on the outside of the housing. The resonator also has a lid which is not shown. An output coupling, not shown, similar to the input coupling connects the metal plate to an output co-axial connector on the outside of the housing.

Suitable dimensions for the resonator are as follows: the housing is 60 mm square and 28 mm deep; the dielectric member is 40 mm in diameter and 20 mm high; the metal plate is 30 mm in diameter and 3 mm thick and the gap between the top of the plate and the lid is 5 mm. A suitable material for the dielectric member is ZTS. By using a dielectric material with a dielectric constant of 44, a resonator with a Q of approximately 4000 and having a resonant frequency of 915 MHz with a first spurious resonance at 1360 MHz can be realised.

Alternatively a resonator as above but with a housing depth of 45 mm, dielectric member thickness of 30 mm and lid-metal plate gap of 12 mm may be constructed. Such a resonator has a Q of approximately 6000, a resonant frequency of 925 MHz and a first spurious resonance at 1145 MHz. As will be appreciated by those skilled in the art, the dimensions of the components of the resonator can be chosen so as to provide a resonator with a geometry configured to provide the desired resonant frequency, Q and spurious bandwidth, i.e. the frequency separation of the resonant frequency and first spurious resonance.

Figure 2B:
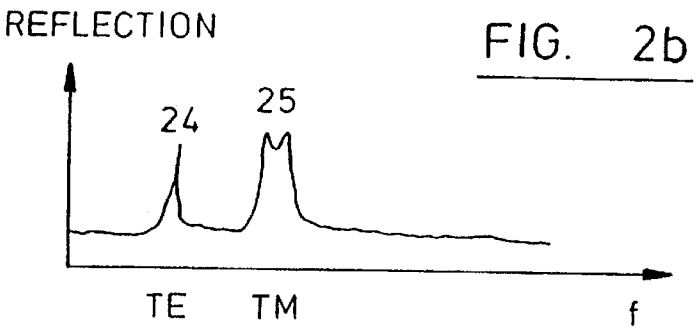
FIGS. 2*a* and 2*b* show a schematic cross sectional view of a freely supported dielectric resonator and its frequency response spectrum for illustrative purposes.
Figure 2A:
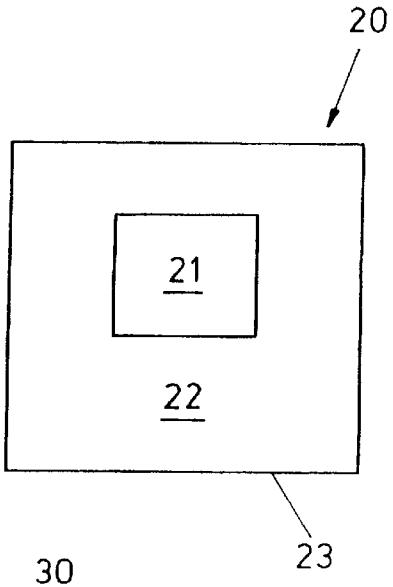

The behaviour of the resonator will now be described with reference to FIGS. 2*a*, 2*b*, 3*a* and 3*b*. FIG. 2*a* shows a schematic diagram of a dielectric resonator 20 in which a dielectric member 21 is freely suspended inside a resonant cavity 22 of a metal housing 23. The dielectric element is not directly in contact with an internal surface of the metal housing, but rather is supported by insulating members which are not shown. FIG. 2*b* shows the frequency response spectrum of such a resonator. The resonator has a natural mode 24 at a first frequency which is a standing TE mode microwave resonance. The resonator also has a natural mode 25 at a second higher frequency which is a standing dual TM mode microwave resonance having two orthogonal modes so that around the frequency of the TM mode both modes of the resonance may be excited by a signal having a similar frequency.

Figure 3B:
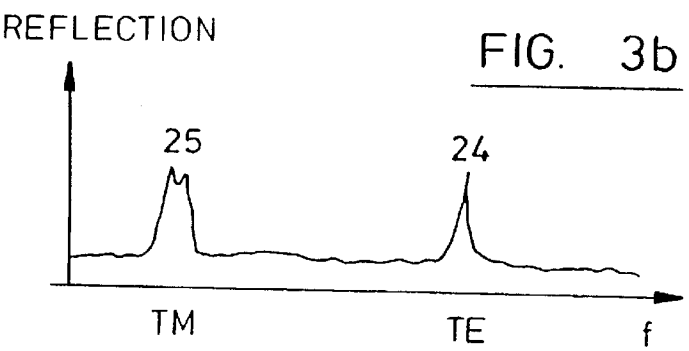
FIGS. 3*a* and 3*b* show a schematic cross sectional view of a resonator according to a first aspect of the invention and its frequency response spectrum.
Figure 3A:
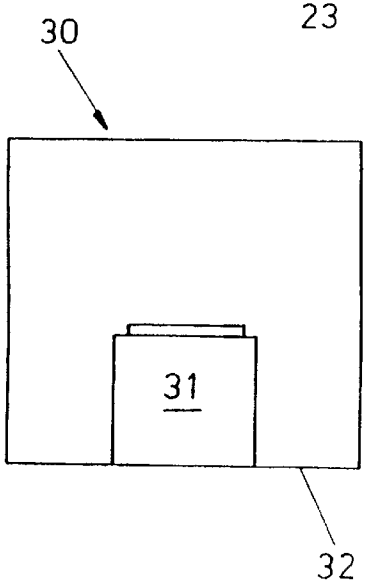

FIG. 3*a* shows a schematic diagram of a resonator 30 according to the invention and FIG. 3*b* the frequency response spectrum of such a resonator. By placing a dielectric member 31 directly in contact with the internal surface of a metal housing 32 of the resonator cavity, the relative position of the dual TM mode and TE mode of the resonator cross over so that the TM mode becomes lower in frequency than the TE mode. Further, by placing a metal plate directly in contact with a top face of the dielectric member, the frequency separation of the TM and TE mode increases. The TM mode consists of a pair of orthogonal resonant modes and so the Q of a resonator using the frequency of the dual TM mode as its resonant frequency effectively doubles. By altering the size of the metal plate with respect to the dielectric member, the frequency separation of the TM and TE modes can be changed.

Hence, the resonator provides a resonator having an enhanced Q compared to similarly dimensioned resonators and with an improved spurious band width. Such a resonator can be used as the resonator in a single resonator microwave filter as will be obvious to those skilled in the art of microwave filter design.

Figure 4:
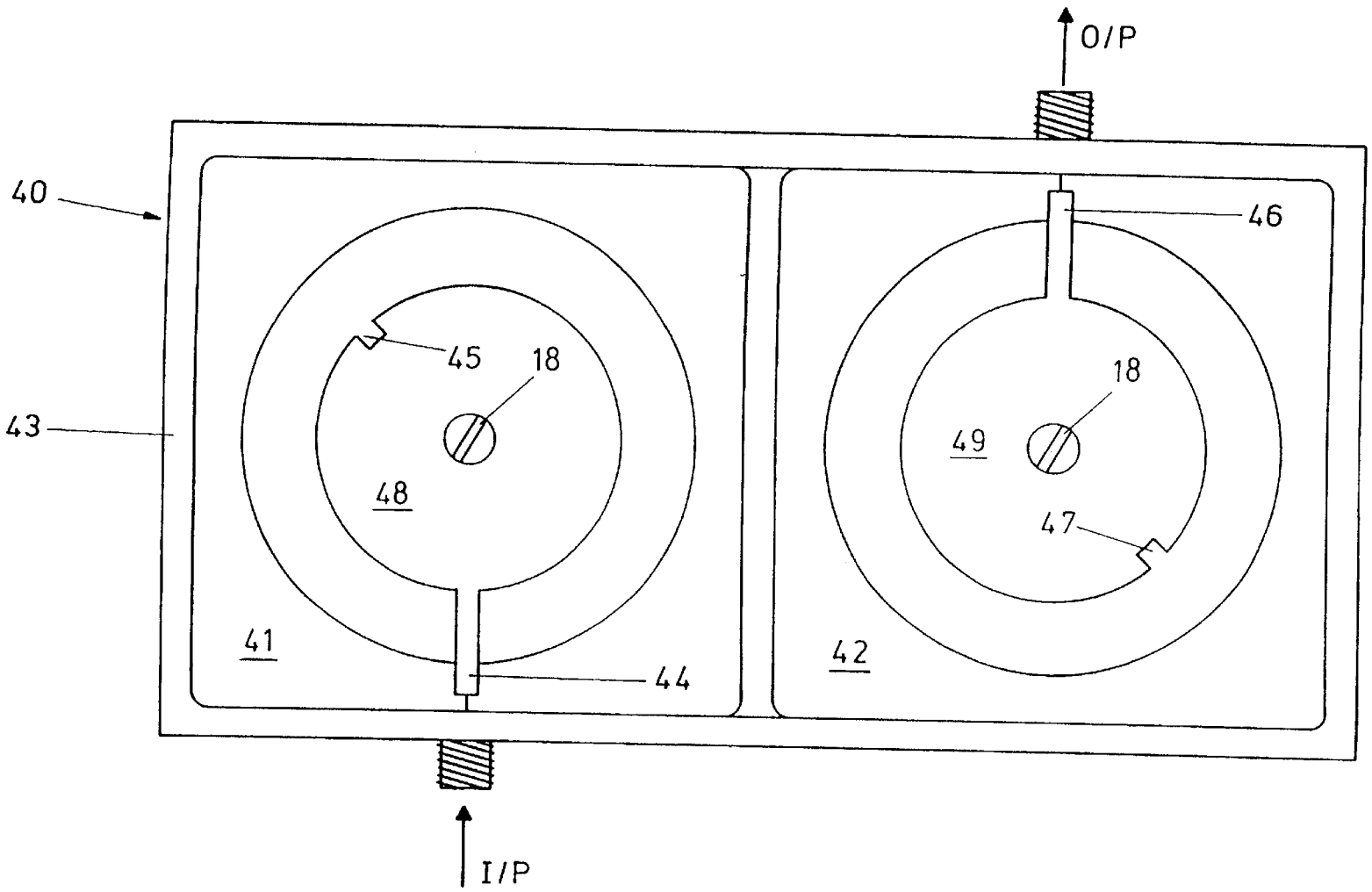
FIG. 4 shows a schematic plan view of a two resonator filter according to a second aspect of the invention.

A filter including resonators according to the invention will now be described with reference to FIG. 4. A microwave filter, designated generally by reference numeral 40, includes a first resonator 41 and a second resonator 42 in a common housing 43. The first resonator has an input coupling 44 for coupling input electronic signals to a first plate 48 of the first resonator. The first plate has a notch 45 in its circumference at a particular position relative to the input coupling as will be described later. The second resonator has an output coupling 46 to output an electrical signal from a second plate 49 of the second resonator. The second plate has a second notch 47 in its circumference at a particular position relative to the first notch 45 and also to the output coupling 46.

Figure 5:
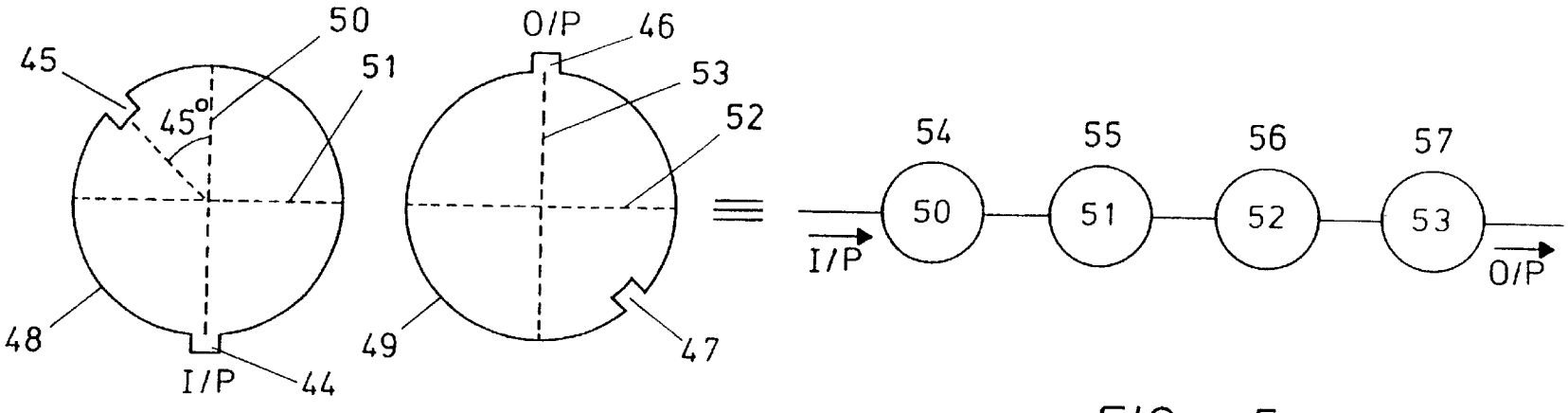
FIG. 5 shows a diagram illustrating the radial electric fields in the plates of a filter and the equivalent serial resonator network.

The behaviour of the filter will now be described with reference to FIG. 5 which shows a diagram of the first 48 and second plates 49 of the filter and an equivalent resonator network. An input electrical signal is coupled to the first plate by coupling 44. In the absence of the first notch 45, the TM mode standing resonance sustained by the resonator has a radial component of the electric field directed diametrically across the plate owing to the nature of the TM mode and the circular symmetry of the plate (as indicated by dashed line 50). By placing a notch in the circumference of the plate at an angle of 45° with respect to the direction of the radial component of the electric field, a second radial component of the electric field is generated across the plate and transversely to the first electric field direction (indicated by dashed line 51). The first and second radial component of the electric field correspond to the two orthogonal modes of the dual TM resonance. The second radial component of the electric field couples to the second plate 49 of the second resonator and induces a first radial electric field in the second plate (indicated by dashed line 52). The second notch 47 causes a second radial electric field to be generated in the second plate transversely to the direction of the first field (indicated by dashed line 53). The second electric field then produces an output signal via output coupling 46.

This arrangement of notches means that each of the physical resonators, 41 and 42, behaves as though it is two resonators. An equivalent resonator network is shown in FIG. 5. The filter 40 is equivalent to an input coupled to a series of four resonators 54 to 57, with first resonator 54 corresponding to radial electric field 50 etc, with a final output. Hence a four resonator filter can be produced from a filter comprising two physical resonators. The design of a filter to provide a particular filter response characteristic, e.g. band pass, from the resonators of the current invention will be understood by those skilled in the art.

Figure 6:
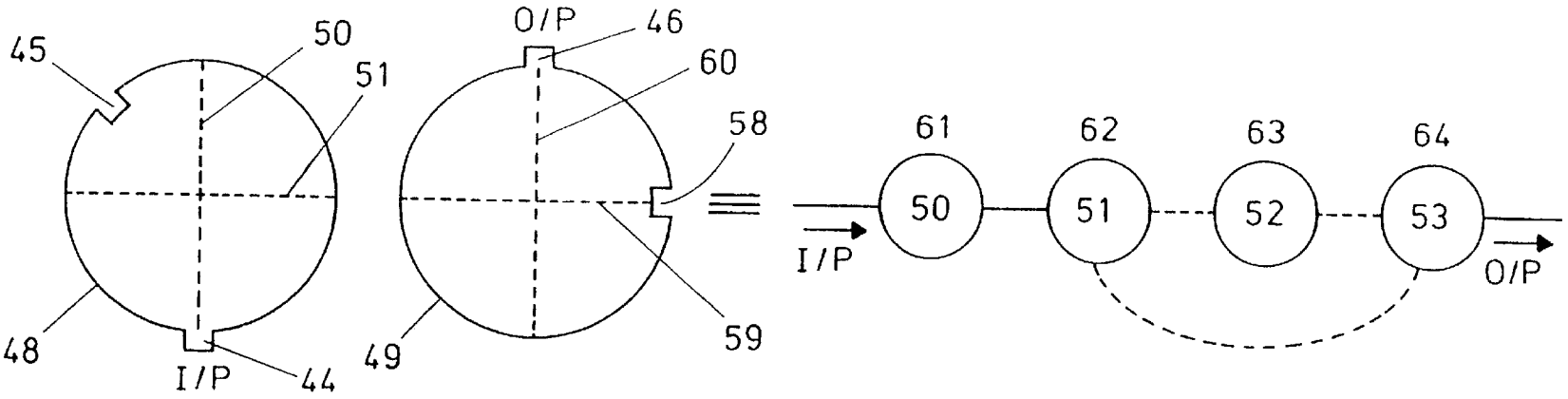
FIG. 6 shows a diagram illustrating the radial electric fields in the plates of a filter and the equivalent cross coupled serial resonator network.

FIG. 6 shows a diagram of a filter in which cross coupling has been introduced into the resonator network. The angular position of the second notch 58 in the second plate 49 of the second resonator has been changed with respect to both the first notch 45 in the first plate 48 and with regard to the output coupling 46 of the second plate. In this configuration, when the radial electric field along direction 51 couples into the plate 49, it induces an electric field corresponding to the parallel components of the electric fields along directions 52 and 53 in the previous case (illustrated by dot-dash line 59). The notch 58 then generates an electric field corresponding to the transverse components of the components of the electric fields along directions 52 and 53 in the previous case which produces a resultant electric field along a direction illustrated by dot-dash line 60. This electric field couples to the output coupling 46 to produce an output electrical signal. The effect of this is to introduce cross coupling between the individual radial electric field resonator modes along directions 51 and 53. The strength of the cross coupling depends on the relative angle between notches 45 and 58 and the output from plate 49 on the position of output coupling 46 relative to notches 45 and 58.

The equivalent resonator network is shown in FIG. 6, in which the filter is equivalent to a series of resonators 61–64 corresponding to radial electric fields along directions 50, 51, 52 & 53 respectively, but with cross coupling between resonators 62 and 64 and the strength of the coupling between resonators 62, 63 and 64 being dependent on the relative angular orientation of notches 45 and 58. The provision of cross coupling in a resonator network allows for poles to be introduced in the transfer function of the filter and hence for the filter characteristic to be changed as desired. Hence, the filter characteristic can be altered in a desired way by varying the relative angular position of the notches.

Filters using more than two resonators according to the current invention are also envisaged.

Figure 7:
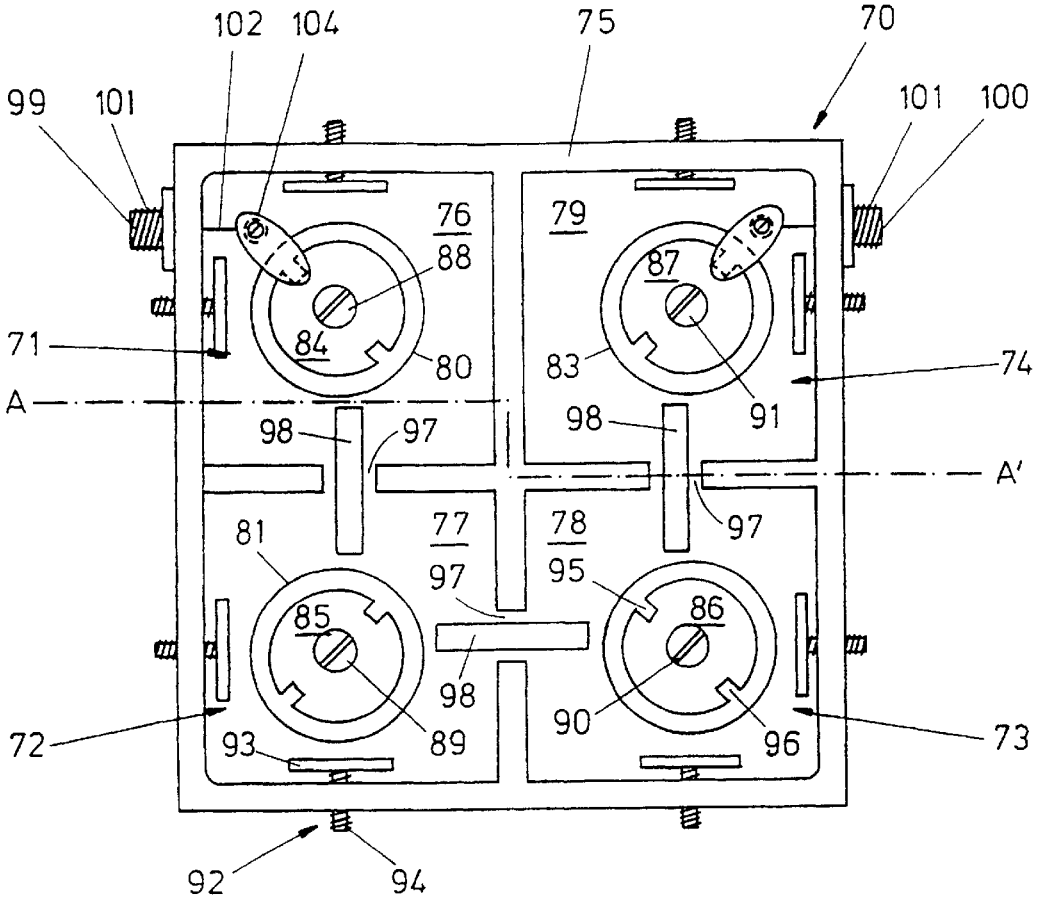
FIG. 7 shows a plan view of a further embodiment of a filter according to a second aspect of the invention.
Figure 8:
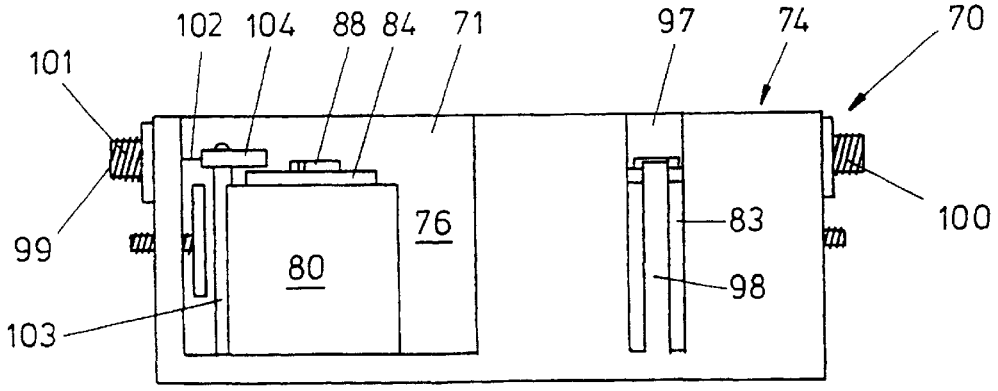
FIG. 8 shows a cross section along line AA' of the filter of FIG. 8.

With reference to FIGS. 7 and 8 there is shown a further embodiment of a filter, designated generally by reference numeral 70, according to a second aspect of the invention. In this embodiment the filter 70 is an eight pole filter.

The filter has four resonators 71,72,73,74 provided in a common housing 75 fabricated from silver coated aluminium. Each resonator includes a cavity 76–79 in which a right circular cylindrical dielectric member 80–83 is situated. A circular conducting plate 84–87 is located on each dielectric member. Each conducting plate has a pair of notches 95,96 in them. The conducting plate and dielectric member are secured to each other and the floor of the cavity housing by an insulating screw fastener 88–91.

The cavities are 60 mm square and 40 mm deep. The dielectric cylinder has a diameter of 40 mm and a depth of 23 mm. The conducting plates have a diameter and 30 mm and a depth of 3 mm. Such dimensions provide a resonator with a Q of approximately 5000.

Each resonator also has a tuning device 92 in the form of a pair of circular metal plates 93 mounted on insulating screw threaded holders 94 in the side walls of the housing of the respective resonator cavities.

Housing walls separating the first and second, second and third and third and fourth resonators have an iris 97 in them, through which a coupling member 98 extends. The filter also has input 99 and output 100 couplings. The input coupling 99 is in the form of a coaxial connector 101 having a transmission line 102 which extends to a post 103 mounted on the base of the housing and with a capacitive probe 104 extending from the post over the conductive disk of the resonator. The output coupling 100 is similarly configured.

Figure 9:
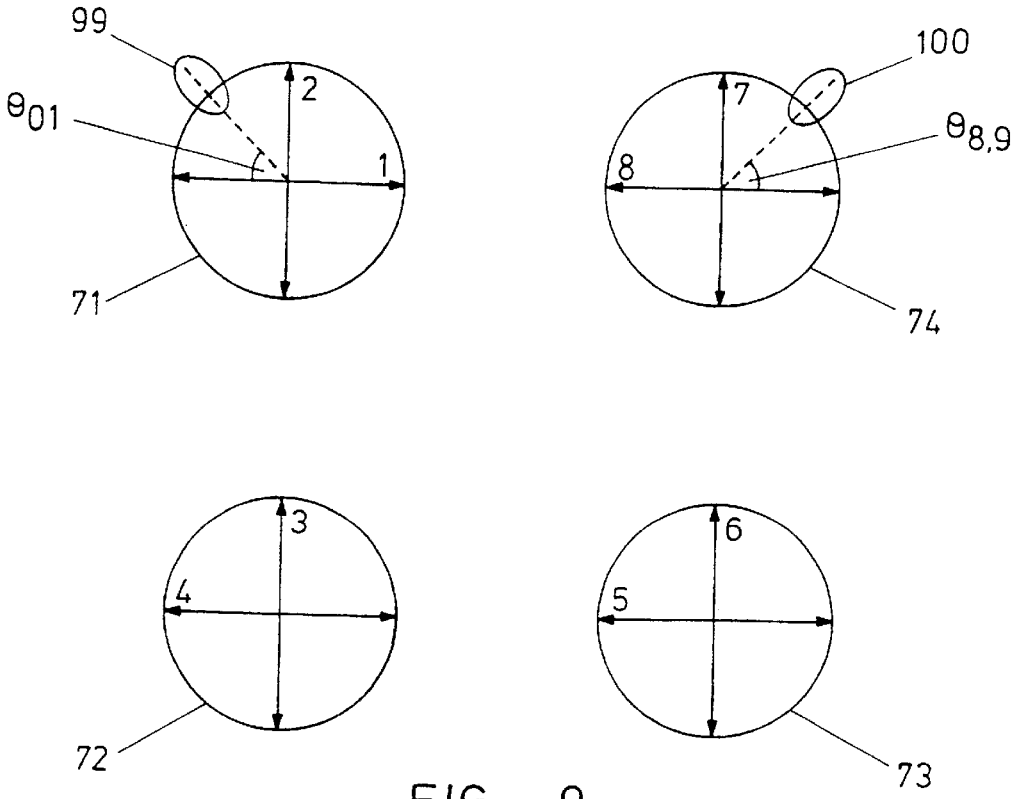
FIG. 9 schematically illustrates the electric field components and relative orientation of the input and output couplings of the filter shown in FIGS. 7 and 8.
Figure 10:
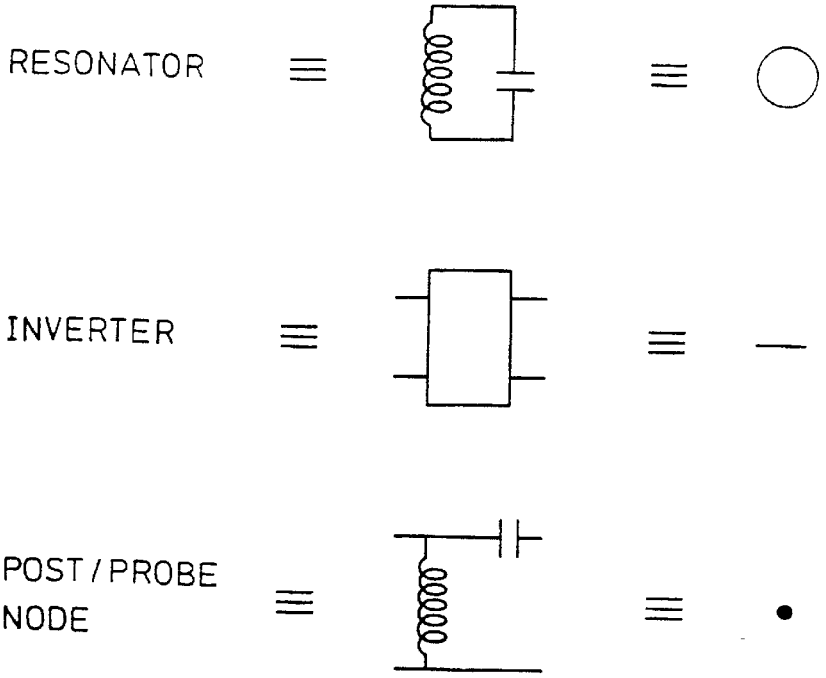
FIG. 10 shows a descriptive illustration of the symbols used in FIG. 11.
Figure 11:
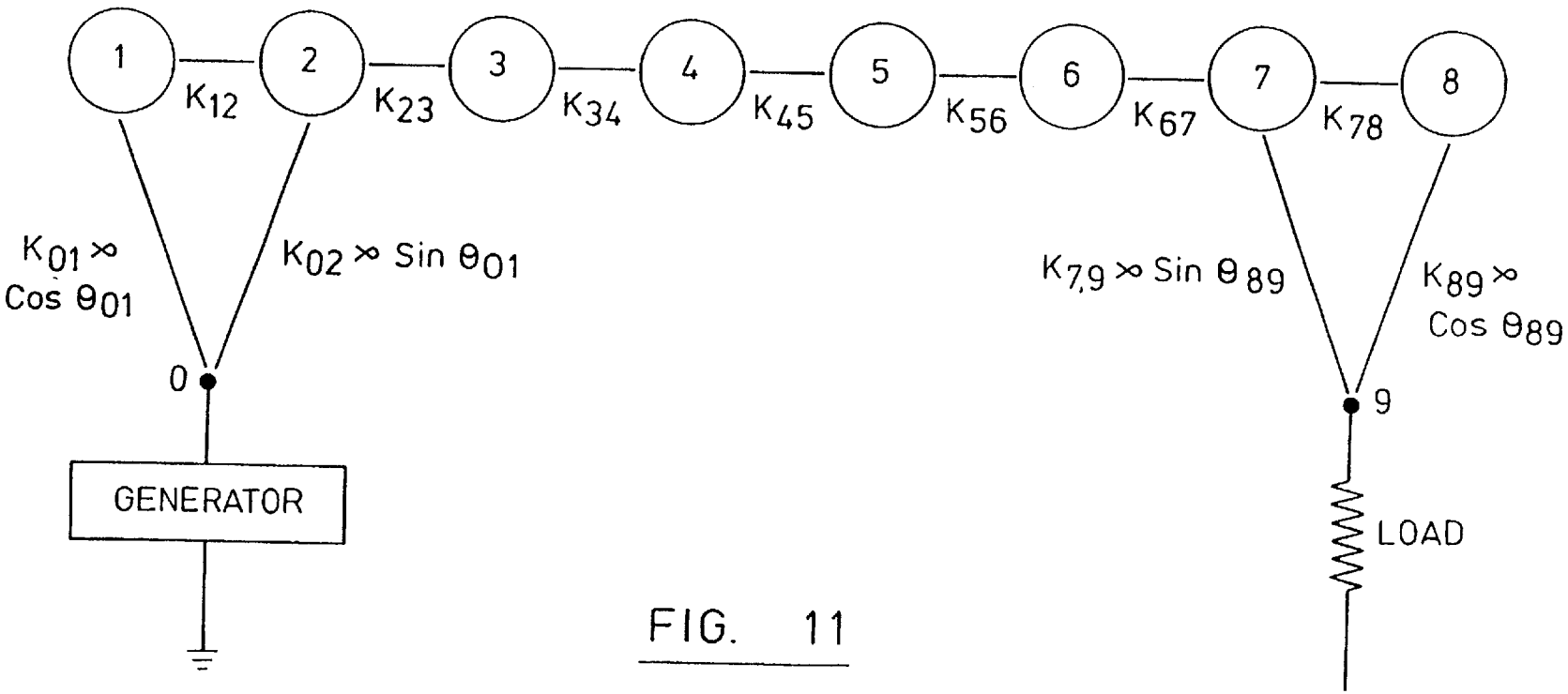
FIG. 11 shows a schematic equivalent circuit of the 8-pole filter shown in FIGS. 7 and 8.

Operation of the filter will now be described with reference to FIGS. 9 to 11. FIG. 9 schematically illustrates the actual resonant natural modes of the physical resonators and their respective configuration together with the input and output couplings. FIG. 10 illustrates the conventional symbols for the component parts of the filter network and the short hand symbols used in FIG. 11. FIG. 11 shows the equivalent circuit diagram to the filter shown in FIGS. 7 and 8.

Electrical energy enters the filter network via the input coupling. The post 103 acts as an inductive reactance to ground and the capacitive probe coupler mounted on the post couples to the electric fields of the conducting plate. As described earlier two degenerate resonant TM modes exist for the resonator in the absence of any notch in the conductive plate. Introducing a notch into the periphery of the plate lifts the degeneracy and broadens the spectrum. Deepening the notch increases the coupling bandwidth but eventually the field pattern becomes distorted. Using two notches can provide the increased bandwidth with less field distortion.

Each resonator supports two orthogonal radial electric field modes. The extent to which the input coupling couples to the two modes of the first resonator is determined by the angle $\theta_{02}$, subtended between the first radial mode and the capacitive coupler. If this angle is zero then the coupling is directly into the first mode. If this angle is greater than zero then there is cross coupling into both the first and second radial modes. In the absence of any cross coupling the filter has a standard Chebychev response. The inclusion of cross coupling introduces an attenuation pole and alters the filter characteristic such that it is no longer symmetric and provides a steeper response to one side as will be appreciated by those skilled in this art.

Hence, as illustrated in FIGS. 10 and 11, the input coupling provides an inductive reactance and capacitance which together act as an inverter providing a first node 0 of the filter network and inverters coupling to the two modes of the first resonator. A generator is coupled to the first and second resonator modes via inverters $K_{01}$, and $K_{02}$, realised by the post/probe input coupling, and the strength of the coupling is determined by the relative angle between the input coupling and the resonator modes. Similarly the output coupling depends on the relative angle $\theta_{8,9}$ between the radial electric field of the last resonator and the output capacitive coupler so that the strength of any cross coupling can be altered. Again, the post/capacitive probe act as inverters $K_{79}$ and $K_{89}$ providing an output node 9 to which a load can be connected.

The coupling between resonators can be improved by the provision of irises 97 and coupling members 98. The irises help to shield out any unwanted coupling between modes of the resonators. The coupling members help to enhance the desired coupling between the resonators by virtues of their physical proximity and concentrating charge such that the desired radial modes couple strongly.

A respective tuning device 92 is provided for each mode of each resonator. As the radial electric field is the strongest, the tuning devices are provided in the side walls of the housing such that as large a surface area of the circular plates as possible is presented substantially perpendicular to the radial fields.

As will be appreciated other multi-pole filter arrangements, by way of non-limiting example 10 pole, can be provided and are envisaged.

What is claimed is:

1. A filter including a microwave frequency composite resonator, the resonator comprising:

a metal housing having an internal surface and defining a resonator cavity;

a substantially circular cylindrical dielectric member; and a circular metal conducting plate, wherein the dielectric member is located within the resonator cavity and directly on the internal surface of the metal housing and the conducting plate is located directly on top of the dielectric member and configured such that in use at resonance the resonator sustains a dual TM mode resonance.

2. A filter as claimed in claim 1, in which a TE mode resonance of the resonator has a resonant frequency higher than the resonant frequency of the TM mode.

3. A filter as claimed in claim 1, and having an input coupling which couples input electrical signals to the conducting plate.

4. A filter as claimed in claim 1, in which there is a notch in the circumference of the conducting plate.

5. A filter as claimed in claim 4, in which the notch is located at an angle of 45° from the direction of a radial component of the electrical field directed diametrically across the conducting plate.

6. A filter as claimed in claim 1, and having an output coupling which couples output electrical signals from the resonator.

7. A filter as claimed in claim 1, and having a second microwave frequency composite resonator.

8. A filter as claimed in claim 7, in which an input coupling couples input electrical signals to the conducting plate of the first resonator and an output coupling couples output electrical signals from the conducting plate of the second resonator.

9. A filter as claimed in claim 8, in which there is a first notch in the circumference of the conducting plate of the first resonator and a second notch in the circumference of the conducting plate of the second resonator.

10. A filter as claimed in claim 9, in which the first notch and second notch angularly displaced such that a radial component of the electric field of a resonant mode in the first resonator couples only to a single radial component of the electrical field of a resonant mode in the second resonator.

11. A filter as claimed in claim 9, in which the first notch and the second notch are angularly displaced such that a radial component of the electric field of a resonant mode in the first resonator couples to both of a pair of radial components of the electric field of a resonant mode in the second resonator so as to cross couple the first and second resonators to provide poles in the filter response characteristic.

12. A filter as claimed in claim 1, in which the filter is a band pass filter.

* * * * *